United States Patent [19]

Schreiber

[11] Patent Number: 4,647,388

[45] Date of Patent: Mar. 3, 1987

[54] TERTIARY AMINE SALT-MOLYBDENUM LUBRICANT ADDITIVE

[75] Inventor: Hans Schreiber, Munich, Fed. Rep. of Germany

[73] Assignee: Optimol Oelwerke GmbH Muenchen, Munich, Fed. Rep. of Germany

[21] Appl. No.: 790,844

[22] Filed: Oct. 24, 1985

[30] Foreign Application Priority Data

Dec. 6, 1984 [DE] Fed. Rep. of Germany ..... 3444553

[51] Int. Cl.[4] ..... C10M 139/00

[52] U.S. Cl. ..... 252/49.3; 252/49.5; 252/49.7; 252/32.7 E; 556/57

[58] Field of Search ..... 252/49.3, 49.5, 49.7, 252/32.7 E; 260/429

[56] References Cited

U.S. PATENT DOCUMENTS

| | | | |
|---|---|---|---|
| 3,235,501 | 2/1966 | Waldmann | 252/49.7 |
| 3,282,838 | 11/1966 | Knowles et al. | 252/49.7 |
| 4,164,473 | 8/1979 | Coupland et al. | 252/32.7 E |
| 4,382,006 | 5/1983 | Horodysky | 252/49.6 |

*Primary Examiner*—Jacqueline V. Howard

*Attorney, Agent, or Firm*—Felfe & Lynch

[57] ABSTRACT

The present invention provides a lubricant additive obtainable by the reaction of a salt of a tertiary amine, which, as N-substituents, contains two polyethylene oxide residues with two or more ethylene oxide groups, the free hydroxyl groups of which can be etherified or acylated, and one saturated or unsaturated long-chain alkyl radical, with ammonium molybdate and/or $MoO_3$.

17 Claims, 20 Drawing Figures

TERTIARY AMINE SALT-MOLYBDENUM LUBRICANT ADDITIVE

The present invention is concerned with a new lubricant additive.

With the development of technology, the requirements demanded of lubricants also increase. Therefore, for a number of years, the primary lubricants, such as mineral and synthetic oils, as well as semi-solid and solid lubricants, have been adapted to the increased requirements by the addition of improvement agents.

From Federal Republic of Germany Patent Specification No. 19 54 452, it is known, for example, to add an epoxidised fatty acid ester and possibly an organic heavy metal compound and/or a sulphur-phosphorus com pound to a lubricant based on mineral oil or synthetic oil.

From Federal Republic of Germany Patent Specification No. 33 03 442 are known lubricating greases based upon mineral or synthetic oils which contain a polyurea compound as thickening agent and for increasing the temperature for prolonged use.

U.S. patent specification No. 4,164,472 describes a molybdenum compound of the general formula:

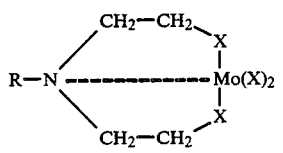

wherein X is an oxygen or sulphur atom and R is a hydrocarbon radical containing up to 50 carbon atoms, which is soluble in hydrocarbons, as a lubricant additive.

The known additives admittedly improve the primary lubricants with regard to the desired properties, for example reduction of wear, improvement of lubricant film adhesion, increase of the oxidation stability, reduction of the temperatures which arise in the case of friction, of the temperature of prolonged use and the like, but no longer satisfy to a satisfactory extent the ever increasing requirements.

Therefore, it is an object of the present invention to provide a lubricant additive which further improves the properties of lubricants to such an extent that they are also fully in accord with the highest requirements.

Thus, according to the present invention, there is provided a lubricant additive obtainable by the reaction of a salt of a tertiary amine, which, as N-substituents, contains two polyethylene oxide residues with two or more ethylene oxide groups, the free hydroxyl groups of which can be etherified or acylated, and one saturated or unsaturated long-chained alkyl radical, with ammonium molybdate and/or $MoO_3$ (molybdic acid).

The tertiary amine salt is preferably used in a mole ratio of 1:1 or more. In particular, the weight ratio of tertiary amine salt to ammonium molybdate ($(NH_4)_2MoO_4$) or $MoO_3$ is 50 to 70:20 to 40 and more preferably 60:25. According to the present invention, "ammonium molybdate" is to be understood also to mean ammonium hetero-polymolybdate or ammonium isomolybdate.

The polyethylene oxide radicals can be different or, preferably, the same and preferably have the general formula $RO—CH_2CH_2\text{-}O—CH_2CH_2)_n$, wherein n is 1 to 15 and R is an alkyl radical containing up to 7 carbon atoms or an acyl radical containing 2 to 7 carbon atoms and is especially a hydrogen atom. In some cases, it can be preferable to select the length of the polyethylene oxide radical according to the nature of the primary oil or grease to which the lubricant additive according to the present invention is to be added; long-chained polyethylene oxide radicals, preferably with n being 10 to 15, are used, for example, especially for primary greases based on glycol.

An alkyl radical containing up to 7 carbon atoms can be branched or preferably straight-chained and is, for example, a methyl, ethyl, propyl, isopropyl, butyl, isobutyl, pentyl, hexyl or 2-, 3- or 4-methylpentyl radical. An acyl radical containing 2 to 7 carbon atoms is, for example, one derived from the above-mentioned alkyl radicals, for example an acetyl, propionyl or like radical.

The long-chained saturated or unsaturated alkyl radical can also be branched but is preferably straight-chained. oleyl (octadecenyl) radical derived from oleic acid. The alkyl radical preferably contains 12 to 24 and especially 16 to 20 carbon atoms and is, in particular, an oleyl radical.

As salt components, there can, in principle, be used any desired organic or inorganic acids, for example, fatty acids, mineral acids and the like. Acids are preferred which, in the lubricant composition, themselves have a positive effectiveness, for example phosphoric acids and partly esterified phosphoric acids, boric acid, sarcosides, mercaptobenzothiazoles, thioglycolic acid and other acids with acidic mercapto groups.

The reaction of the tertiary amine salt with the ammonium molybdate or $MoO_3$ takes place, especially having regard to a subsequent use as a package in the form of a solution or suspension in a mineral or synthetic oil, by heating in a mineral or synthetic oil; the reaction is preferably carried out at a temperature of from 100° to 220 °C. and especially of from 130° to 190 °C. The reaction is preferably carried out in the presence of a small amount of water. Additions of water of from about 5 to about 20% by weight, referred to the reaction product, give good results. The reaction is thereby accelerated and the necessary reaction temperature lowered into the lower range.

The starting materials for the reaction are known or can be prepared in known manner.

The production of the tertiary amine salt can take place, for example, by the reaction of a primary amine, which already carries the long-chained alkyl radical, for example of oleylamine, with ethylene oxide in the mole ratio required for the desired polyethylene oxide chain; the free hydroxyl group can subsequently be etherified or esterified in known manner, for example by reaction with an alkyl or acyl halide. The conversion into the amine salt preferably takes place by a simple salt-formation reaction of the tertiary amine with the selected acid.

The lubricant additive preferably also contains one or more sulphur compounds selected from sulphonated esters, heavy metal dithiophosphates and heavy metal dithiocarbamates.

As sulphonated esters, there can be used all sulphur-containing esters of vegetable, animal or synthetic origin; typical, appropriate commercially available products include, for example, "Lubrizol" 5003 available from Lubrizol GmbH, Hamburg), "Maisperm" 2011

(available from Lehmann, Voss & Co., Hamburg) and sulphonated jojoba oil.

As heavy metal dithiophosphates, there can, in general, be used all dithiophosphates of the transition metals and of the rare earth metals, especially the thiophosphates of antimony, lead, tin, iron, copper, manganese, molybdenum, nickel, vanadium, titanium and bismuth and, in particular, of zinc and tellurium. Instead of the dithiophosphates, there can also be used the corresponding dithiocarbamates. In these compounds, the sulphur can be wholly or partly replaced by selenium or tellurium.

In the lubricant additive according to the present invention, the weight ratio of reaction product of tertiary amine salt and molybdenum compound to sulphur compound is preferably from 1:0.5 to 1:10.

The lubricant additive according to the present invention is preferably present as a package in the form of a solution or suspension in a primary oil (mineral or synthetic oil) and is preferably sold and used in this form. In such a package, the content of lubricant additive (tertiary amine salt/molybdenum compound reaction product and optionally sulphur compound and/or other conventional additives) is usually 30 to 90% by weight and especially 50 to 70% by weight.

As mineral primary oils and greases, there can be used naphthene-based or paraffin-based primary oils and greases and, in the case of synthetic primary oils and greases, there can be used all conventional classes thereof. Typical examples of appropriate synthetic oils include poly-alpha-olefins, glycols, esters, alkylbenzenes and silicone oils and greases which are soluble in organic solvents.

The lubricating additives according to the present invention can contain further oil-soluble and oil-insoluble additives which are conventional for lubricating oils, for example, anti-oxidants, rust inhibitors, thickening swelling agents, antifoaming agents, dispersion agents, colouring materials, viscosity index improvers and extreme pressure additives, but also other lubricant additives, for example additive combinations known, for example, from Federal Republic of Germany Patent Specification No. 19 54 452.

Lubricating oils and greases with substantially improved properties can be obtained with the lubricant additives according to the present invention. In particular, by means of lubricant additives according to the present invention, the wear is decreased, the adhesion of the boundary lubricant film is improved, the oxidation stability and thus the period of life of the lubricant is outstandingly increased and the coefficient of friction and thus also the operating temperature is lowered. The friction values achieved with the lubricant additive according to the present invention are extremely low. The amount of lubricant additive according to the present invention (reaction product of tertiary amine salt with molybdenum compound and optionally sulphur compounds) and optionally of further conventional additives, is, as a rule, at least 3% , referred to the final composition of the lubricant, the most appropriate amounts thereby being easily ascertainable for the particular lubricant and the particular intended use. With the lubricating additive according to the present invention, there can also be produced lubricating oil and lubricating grease concentrates which are then added to the lubricant up to the desired concentration. In the same way, the additives according to the present invention can be used in acidic, neutral or basic media. Therefore, the present invention is also concerned with the use of the lubricant additives according to the present invention for lubricating materials and lubricating greases, especially for gear and motor oils. By means of the use of the lubricant additive according to the present invention, it is, for example, possible also to use oils of lower viscosity in fields of use where hitherto high viscosities were absolutely necessary, for example in gears and differential gears.

The following Examples are given for the purpose of illustrating the present invention:

EXAMPLE 1

(a) 15 Parts by weight of ammonium molybdate or 12 parts by weight of $MoO_3$, 60 parts by weight of tertiary amine salt (n =1; long-chained alkyl radical =oleyl; boric acid salt), 25 parts by weight of mineral oil and 10 parts by weight of water are mixed and stirred for 1 to 2 hours at 150° C. in such a manner that a homogeneous mixture is maintained.

(b) The process of (a) is repeated but with the use of a different tertiary amine (n =15, oleyl radical).

(c) The process of (a) is repeated but with the N-oleyl-sarcoside salt instead of the boric acid salt.

The solutions of the lubricant additives according to the present invention obtained according to (a), (b) or (c) can be used as such, possibly together with a sulphonated ester, a heavy metal dithiophosphate and/or a heavy metal dithiocarbamate, as package for the production of improved lubricating greases and lubricating oils.

EXAMPLE 2

By mixing 2 parts by weight of a reaction product obtained according to Example 1 (a) in mineral oil, 4 parts by weight of sulphonated ester and 2 parts by weight of zinc dithiophosphate, a lubricating agent package is produced which is used in the following Examples as an additive for lubricants.

EXAMPLE 3

(a) With the use of mineral oil plus lithium soap as primary grease, there is produced a lubricant composition which contains 8% by weight of the package obtained according to Example 2 by mixing the components.

(b) As described in (a), a lubricant composition is produced which contains 5% by weight of the package obtained according to Example 2.

EXAMPLE 4

The procedure according to Example 3 (a) is used but with the use of a primary grease based upon:

(a) polyglycol/lithium soap;

(b) poly-alpha-olefin (low viscosity)/lithium soap;

(c) ester/lithium soap.

EXAMPLE 5

With the use of a commercially available super motor oil SAE 30 as primary oil, there is produced a lubricating oil composition which contains 3% by weight of the package obtained according to Example 2, by mixing the components.

EXAMPLE 6

With the use of a grease of lithium 12-hydroxystearate as thickener and a synthetic oil based upon (a) polyglycol or b) esters, there is produced a lubricant composition which contains 8% by weight of the lubricant additive obtained according to Example 1 (c), by mixing the components.

The lubricant compositions (a) or (b) show, in the SRV test, similarly good results as are obtained with the comparable lubricant compositions which contain 8% by weight of the package obtained according to Example 2 which thus, in addition to the reaction product of tertiary amine salt and molybdenum compound, also contain a sulphur compound.

EXAMPLE 7

(COMPARATIVE EXAMPLE)

In the manner described in Example 3 (a), with the use of mineral oil plus lithium soap as primary grease, there is produced a lubricant composition which, however, instead of 8% by weight of the package according to Example 2, contains 8% by weight of the following mixture in which the reaction product of tertiary amine salt and molybdenum compound is replaced by the same amount of a commercially available molybdenum compound for lubricants:

2 parts by weight of Molyvan L (sulphonated oxymolybdenum dialkyl dithiophosphate)

4 parts by weight sulphonate ester 2 parts by weight zinc dithiophosphate.

The tests for the assessment of the lubricating properties were carried out with an SRV apparatus which is commercially available from Optimol Ölwerke GmbH, Munich, Federal Republic of Germany (cf. R. Schumann, ant. "Antriebstechnik", 19, No. 1-2(1980).

The results of the tests can be seen from the accompanying FIGS. 1 to 20 in the form of SRV test sheets.

FIGS. 1 to 12 show the properties of lubricant compositions with the use of lubricant additive according to the present invention and FIGS. 13 to 20 the results without the lubricant additive according to the present invention or with other additives.

In particular, the Figures are concerned with the following lubricant compositions:

FIGS. 1 to 7: lubricant composition according to Example 3 (a);

FIG. 8: lubricant composition according to Example 3 (b);

FIG. 9: lubricant composition according to Example 4 (a);

FIG. 10: lubricant composition according to Example 4 (b);

FIG. 11: lubricant composition according to Example 5;

FIG. 12: lubricant composition according to Example 6;

FIGS. 13 to 18: (comparative): commercially available lubricant grease Longtime PD 2 (commercial product of Optimol Ölwerke GmbH, Munich, Federal Republic of Germany);

FIG. 19 (comparative): composition as in Example 4 (a) but without the lubricant additive according to the present invention; and FIG. 20 (comparative): composition according to Example 7.

The conditions under which the tests represented in FIGS. 1–20 were accomplished are as shown in the following tables:

| | FIG. 1 | FIG. 2 | FIG. 3 | FIG. 4 | FIG. 5 | FIG. 6 | FIG. 7 |
|---|---|---|---|---|---|---|---|
| Product | FETT SP 11 | M 159/6 | M 159/6 | FETT M 159/6 | FETT M 159/6 | FETT M 159/6 | FETT M 159/6 |
| Date | 6-30-83 | 6-29-84 | 6-28-84 | 6-27-84 | 7-4-84 | 7-5-84 | 6-27-84 |
| Test Mode | E.P. | 2 | 3 α e | 5 α e | 5 α e spez. | 5 α e sp. | 3 Ce |
| Load | 50/1100 N | 100 N | 200 N | 300 N | 300 N | 300 N | 400 N |
| Stroke | 1000 μm | 1000 μm | 1000 μm | 1000 μm | 1000 μm | 1000 μm | 1000 μm |
| Frequency | 50 Hz | 50 Hz | 50 Hz | 50 Hz | 50 Hz | 50 Hz | 50 Hz |
| Total Friction Run | | 720 m | 720 m | 720 m | 720 m | 720 m | 720 m |
| Temperature | 80° C. | 50° C. | 50° C. | 50° C. | 50° C. | 50° C. | 50° C. |
| Test Duration | 2 min/Last | 2 h | 2 h | 2 h | 2 h | 2 h | 2 h |
| Result | | | | | | | |
| Min. Friction Coefficient | | 0.041μ | 0.029μ | 0.025μ | 0.062μ | 0.023μ | 0.024μ |
| Max. Friction Coefficient | | 0.125μ | 0.140μ | 0.135μ | 0.125μ | 0.145μ | 0.132μ |
| Profile Depth | | 1.0 μm | 0.4 μm | 0.8 μm | 1.3 μm | not meas. | 0.6 μm |
| Maximum Wave Depth | | 0.4 μm | 0.2 μm | 0.3 μm | 0.7 μm | | 0.2 μm |
| Ball Scar Diamer | | 0.45 mm | 0.55 mm | 0.55 mm | 0.50 mm | 0.75 mm | 0.65 mm |
| Classification of Scars | | | | | | | |
| Specimens | | | | | | | |
| Ball | 17.5 mm | 10 mm | 10 mm | 10 mm | 10 mm | 10 mm | 10 mm |
| Cylinder | | | | | | | |
| Ring | | | | | | | |
| Surface Pt | 0.2 μm | 0.2 μm | 0.2 μm | 0.2 μm | 0.1 μm | 0.8 μm | 0.2 μm |
| Special Configuration | | | | | | | |

| | FIG. 8 | FIG. 9 | FIG. 10 | FIG. 11 | FIG. 12 | FIG.13 |
|---|---|---|---|---|---|---|
| Product | PD GROND FETT + 5% SP 11 | M122/4 + 10% SP11 FETT | FETT M118/3 | MOT-HD SAE 30 + 3% SP11 | FETT SPN 2(mit N—Acyl-Sar coxid | LONGTIME PD 2Ch 1329 |
| Date | 7-10-84 | 10-13-83 | 6-30-83 | 7-23-84 | 11-5-84 | 7-1-84 |
| Test Mode | 5 α e | 5 α e | 5 α e | 5 α e | 5 α e | 2 |
| Load | 300 N | 300 N | 300 N | 300 N | 300 N | 100 N |
| Stroke | 1000 μm | 1000 μm | 1000 μm | 1000 μm | 1000 μm | 1000 μm |
| Frequency | 50 Hz | 50 Hz | 50 Hz | 50 Hz | 50 Hz | 50 Hz |
| Total Friction Run | 720 m | 720 m | 720 m | 720 m | 720 m | 720 m |
| Temperature | 50° C. | 50° C. | 50° C. | 50° C. | 50° C. | 50° C. |
| Test Duration | 2 h | 2 h | 2 h | 2 h | 2 h | 2 h |
| Result | | | | | | |

-continued

| | | | | | | |
|---|---|---|---|---|---|---|
| Min. Friction Coefficient | 0.038μ | 0.107μ | 0.031μ | 0.044μ | 0.034μ | 0.049μ |
| Max. Friction Coefficient | 0.140μ | 0.119μ | 0.134μ | 0.142μ | 0.127μ | 0.0124μ |
| Profile Depth | 0.8 μm | 1.0 μm | 0.6 μm | 0.6 μm | 0.7 μm | 0.7 μm |
| Maximum Wave Depth | 0.3 μm | 0.5 μm | 0.2 μm | 0.2 μm | 0.3 μm | 0.3 μm |
| Ball Scar Diamer | 0.67 mm | 0.70 mm | 0.62 mm | 0.75 mm | 0.52 mm | 0.37 mm |
| Classification of Scars | | | | | | |
| Specimens | | | | | | |
| Ball | 10 mm | 10 mm | 10 mm | 10 mm | 10 mm | 10 mm |
| Cylinder | | | | | | |
| Ring | | | | | | |
| Surface Pt | 0.2 μm | 0.2 μm | 0.2 μm | 0.2 μm | 0.2 μm | 0.2 μm |
| Special Configuration | | | | | | |

| | FIG. 14 | FIG. 15 | FIG. 16 | FIG. 17 | FIG. 18 | FIG. 19 | FIG. 20 |
|---|---|---|---|---|---|---|---|
| Product | LONGTIME PD 2 Ch 1329 | LONGTIME PD 2 Ch 1329 | LONGTIME PD 2 Ch 1329 | LONGTIME PD 2 Ch 1329 | LONGTIME PD 2 Ch 1329 | TPG 101 | FETT M 159/5 |
| Date | 7-2-84 | 6-25-84 | 7-5-84 | 7-5-84 | 7-2-84 | 11-28-83 | 6-28-84 |
| Test Mode | 3 α e | 5 α e | 5 αe sp. | 5 αe sp. | 3 ce | 5 α e | 3 ce |
| Load | 200 N | 300 N | 300 N | 300 N | 400 N | 300 N | 400 N |
| Stroke | 1000 μm | 1000 μm | 1000 μm | 1000 μm | 1000 μm | 1000 μm | 1000 μm |
| Frequency | 50 Hz | 50 Hz | 50 Hz | 50 Hz | 50 Hz | 50 Hz | 50 Hz |
| Total Friction Run 720 m | 720 m | 720 m | 720 m | 720 m | 720 m | 720 m | 720 m |
| Temperature | 50° C. | 50° C. | 50° C. | 50° C. | 50° C. | 50° C. | 50° C. |
| Test Duration | 2 h | 2 h | 2 h | 2 h | 2 h | 2 h | 2 h |
| Result | | | | | | | |
| Min. Friction Coefficient | 0.118μ | 0.049μ | 0.050μ | 0.130μ | 0.043μ | 0.108μ | 0.072μ |
| Max. Friction Coefficient | 0.135μ | 0.132μ | 0.099μ | 0.145μ | 0.113μ | 0.300μ | seize μ |
| Profile Depth | 0.8 μm | 0.5 μm | 6.0 μm | 6.0 | 1.0 μm | 2.8 μm | 23 μm |
| Maximum Wave Depth | 0.3 μm | 0.2 μm | | | 0.5 μm | 2.2 μm | 19 μm |
| Ball Scar Diamer | 0.90 mm | 0.82 mm | 0.55 mm | 0.95 mm | 0.80 mm | 0.70 mm | 0.75 mm |
| Classification of Scars | | | | | | | |
| Specimens | | | | | | | |
| Ball | 10 mm | 10 mm | 10 mm | 10 mm | 10 mm | 10 mm | 10 mm |
| Cylinder | | | | | | | |
| Ring | | | | | | | |
| Surface Pt | 0.2 μm | 0.2 μm | 0.1 μm | 0.8 μm | 0.2 μm | 0.2 μm | 0.2 μm |
| Special Configuration | | | | | | | |

FIG. 1 illustrates a test in which the lubricant composition according to Example 3 (a) is subjected under the stated operating conditions to a loading increasing from 50 to 1000 Newton, without the lubricating effectiveness thereby collapsing. This means that the flow boundary of the metal is achieved in the surface roughnesses without the lubricant action of the lubricant composition according to the present invention being lost.

In the tests illustrated by FIGS. 2 to 7 with a lubricant composition according to the present invention according to Example 3 (a) and the corresponding tests used for comparison (FIGS. 13 to 8) with Longtime PD2, there were used test bodies with lapped surface (smooth), with ground surface (rough) and also those with polished surface (highly polished). In the case of uniform loading (at 300 N), a comparison of FIGS. 4 to 6 with FIGS. 15 to 17 shows the superiority of the grease according to the present invention especially clearly in the case of the rough surface. However, the results of the experiments with lapped and with polished surfaces clearly show the superiority of the lubricant according to the present invention. In the case of the polished surface, it is especially note-worthy that pitting occurred with the comparison product. In the case of the lapped surface, the differences, especially in the case of the friction values and in the profilograms, become ever more serious with increased loading but are already clearly marked even at 200 N.

FIGS. 9 and 19 (comparative) show the results with a lubricant composition based on polyglycol plus lithium soap with and without the lubricant additive according to the present invention.

FIGS. 7 and 20 (comparative) show the results with a lubricant composition with the use of a lubricant additive according to the present invention (Example 3 (a)) and of one with a known lubricant additive (Example 7) based on the same primary oil (mineral oil plus lithium soap); the profilogram shows especially clearly the superiority of the lubricant composition with the lubricant additive according to the present invention.

In the case of the tests of FIGS. 7 and 20 (comparative), there were also taken electron raster pictures of the lapped surfaces of the contact surfaces impinged against with 400 times and 1500 times enlargement before and after the friction experiment. A comparison of the worn surfaces clearly shows that with the product containing the Molyvan L, flake-like tears occur whereas in the case of the product according to the present invention, a very smooth contact surface is achieved which, on the place impinged against, has a better appearance than the place not impinged against.

Figure 11:
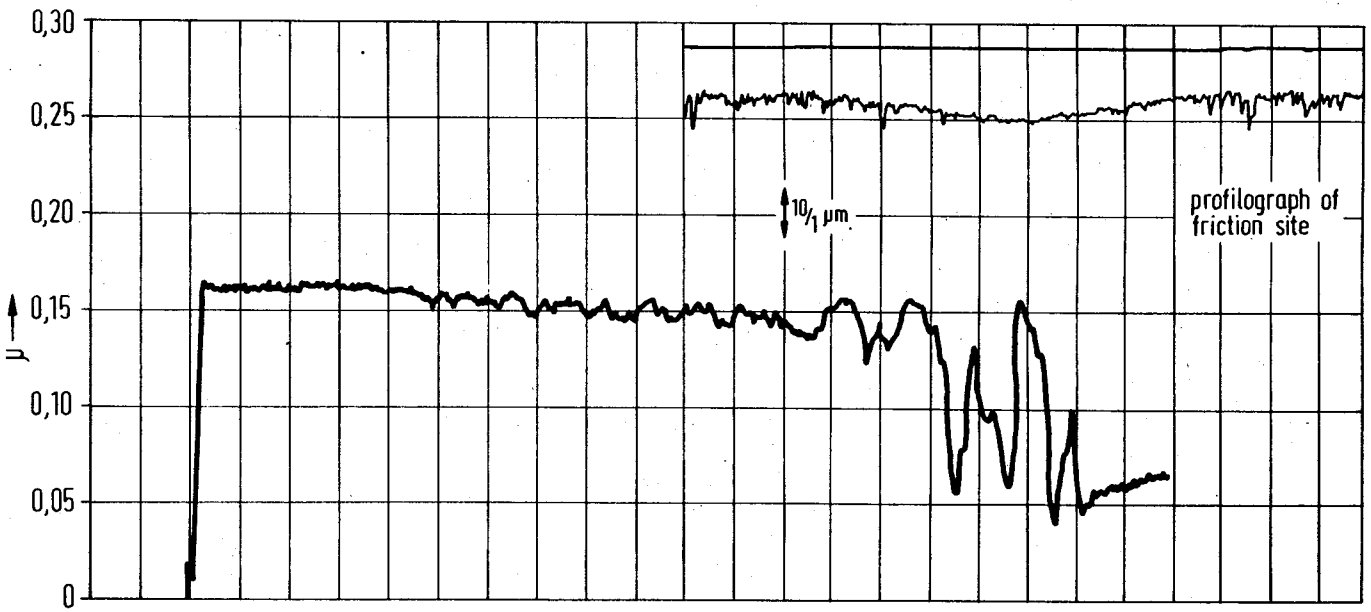

FIG. 11 shows the results with a commercially available super motor oil SAE 30 which contains only a small amount (3% by weight) of lubricant additive according to the present invention. The results show that, after a short running-in period, a considerable reduction of the friction value occurs, which was previously about 0.13 to 0.044. This result is especially remarkable because, in the case of such a commercially available lubricating oil with all the additives present, detergents are also present which reduce the action of the lubricant additive according to the present invention but, nevertheless, a distinct improvement of the lubricant properties is achieved.

Figure 12:
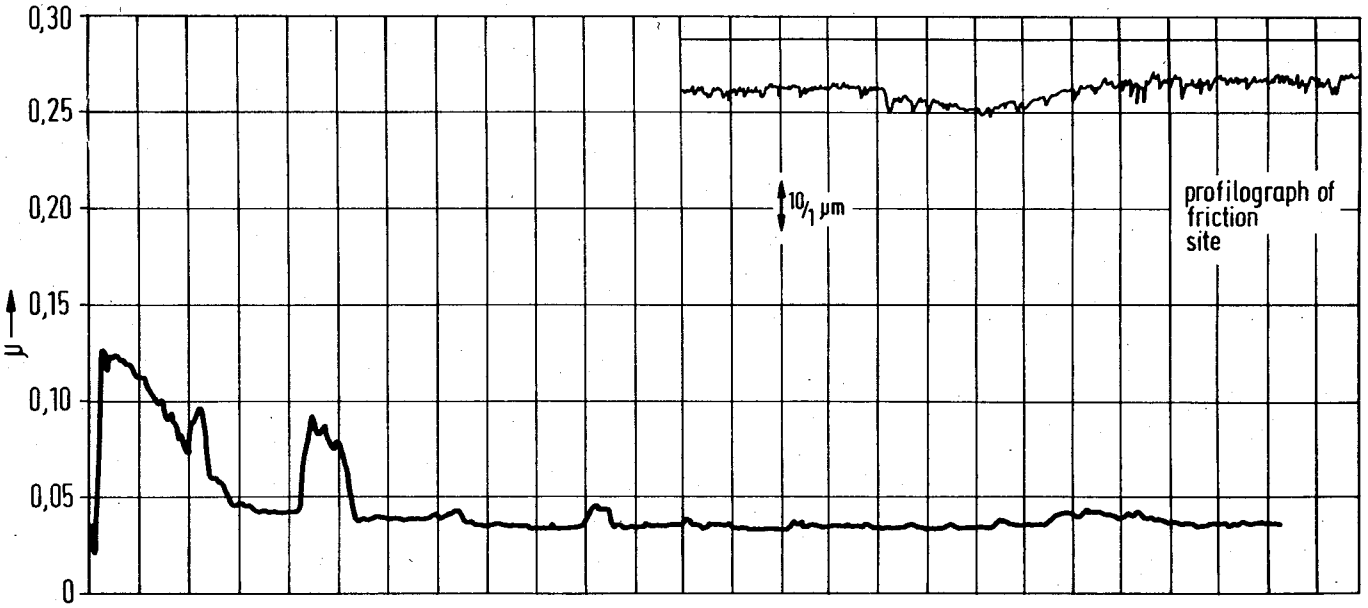
Figure 13:
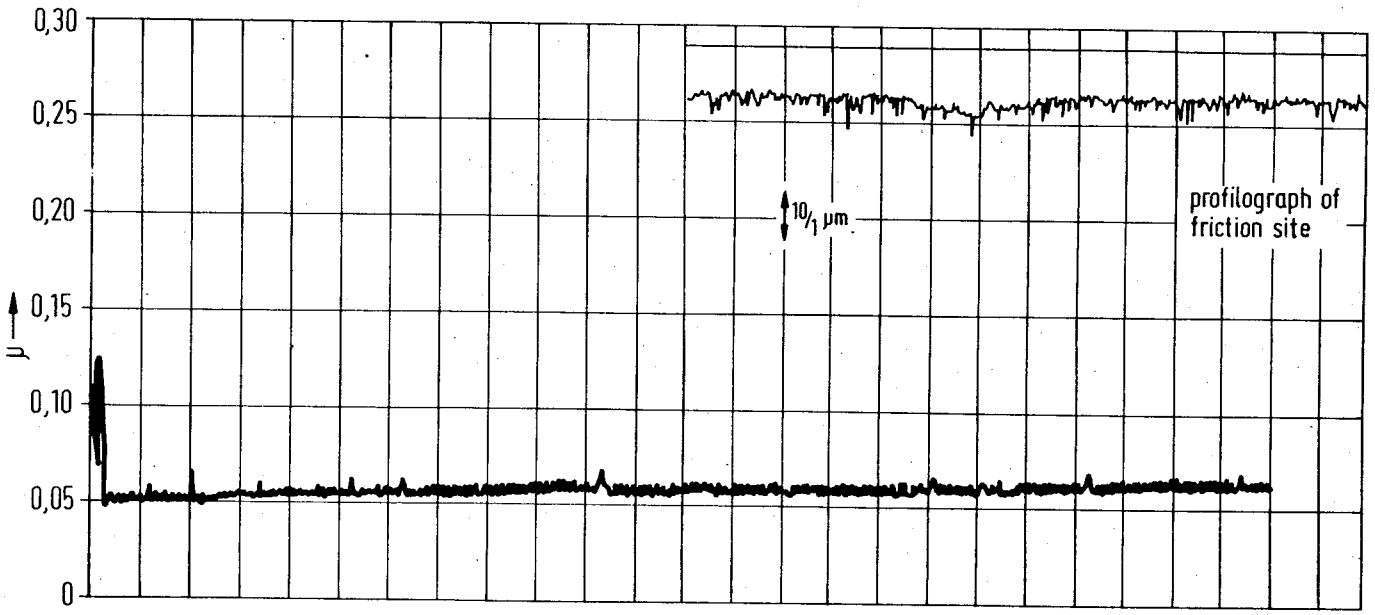

FIG. 12 shows that in the case of a lubricating grease, too, outstanding friction values and surface smoothnesses are achieved with the use of an additive according to the present invention.

I claim:

1. A lubricant additive formed by the reaction, at a temperature of 100° to 220° C. and in a ratio by weight of 50 to 70:20 to 40, of a salt of a tertiary amine, with, as N-substituents, two polyethylene oxide residues containing two or more ethylene oxide groups, the free hydroxyl groups of which being unsubstituted or etherified or acylated, and one saturated or unsaturated long-chain alkyl radical, with a molybdenum compound selected from the group consisting of ammonium molybdate, $MoO_3$ or a mixture thereof.

2. The lubricant additive according to claim 1, wherein the polyethylene oxide residues are the same or different and have the formula $RO—CH_2—CH_2—(—O—CH_2CH_2—)_n$, wherein n is 1 to 15 and R is hydrogen, alkyl 1 to 7 carbon atoms or an acyl containing 2 to 7 carbon atoms.

3. The lubricant additive according to claim 1, wherein the long-chain alkyl radical is derived from a saturated or unsaturated fatty acid.

4. The lubricant additive according to claim 1, wherein the long-chain alkyl radical contains 12 to 24 carbon atoms.

5. The lubricant additive according to claim 4, wherein the long-chain alkyl radical contains 16 to 30 carbon atoms.

6. The lubricant additive according to claim 5, wherein the long-chain alkyl radical is an oleyl radical.

7. The lubricant additive according to claim 1, wherein the reaction takes place in a mineral oil or synthetic oil with heating to a temperature of from 100° C. to 220° C.

8. The lubricant additive according to claim 1, wherein the tertiary amine salt is reacted with the molybdenum compound in a mole ratio of 1:1 or more.

9. The lubricant additive according to claim 1, wherein the weight ratio of tertiary amine salt to molybdenum compound is 60:25.

10. The lubricant additive according to claim 9, wherein the weight ratio of tertiary amine salt to molybdenum compound is 60:25.

11. The lubricant additive according to claim 1, wherein the reaction is carried out at a temperature of from 130° to 190° C.

12. The lubricant additive according to claim 11, wherein the reaction is carried out at a temperature of from 130° to 190°0 C.

13. The lubricant additive according to claim 1, further comprising one or more sulphur compounds selected from the group consisting of sulphonated esters, heavy metal dithiophosphates and heavy metal dithiocarbamates.

14. The lubricant additive according to claim 13, wherein the weight ratio of reaction product of tertiary amine salt and molybdenum compound is from 1:05 to 1:10.

15. The lubricating additive according to claim 1 in the form of a 30 to 90% by weight solution or suspension in a mineral oil or synthetic oil.

16. The lubricant additive of claim 1 wherein the reaction takes place in the presence of 5 to 20% by weight of water.

17. The lubricant additive of claim 1 wherein the weight ratio of molybdenum compound to tertiary amine salt is 20 to 40:50 to 70, the long chain alkyl radical is oleyl and the amine salt is a boric acid salt.

* * * * *

UNITED STATES PATENT AND TRADEMARK OFFICE

CERTIFICATE OF CORRECTION

PATENT NO. : 4,647,388

DATED : March 3, 1987

INVENTOR(S) : Hans Schreiber

It is certified that error appears in the above-identified patent and that said Letters Patent is hereby corrected as shown below:

Col. 1, line 17 "com pound" should read -- compound --;

Col. 2, line 21, "chained. oleyl (octadecenyl) radical derived from oleic" should read -- chained. It is preferably an alkyl radical derived from a saturated or unsaturated fatty acid, for example an oleyl (octadecenyl) radical --

Col. 7, line 48, "8" should read -- 18 --

Figure 1:
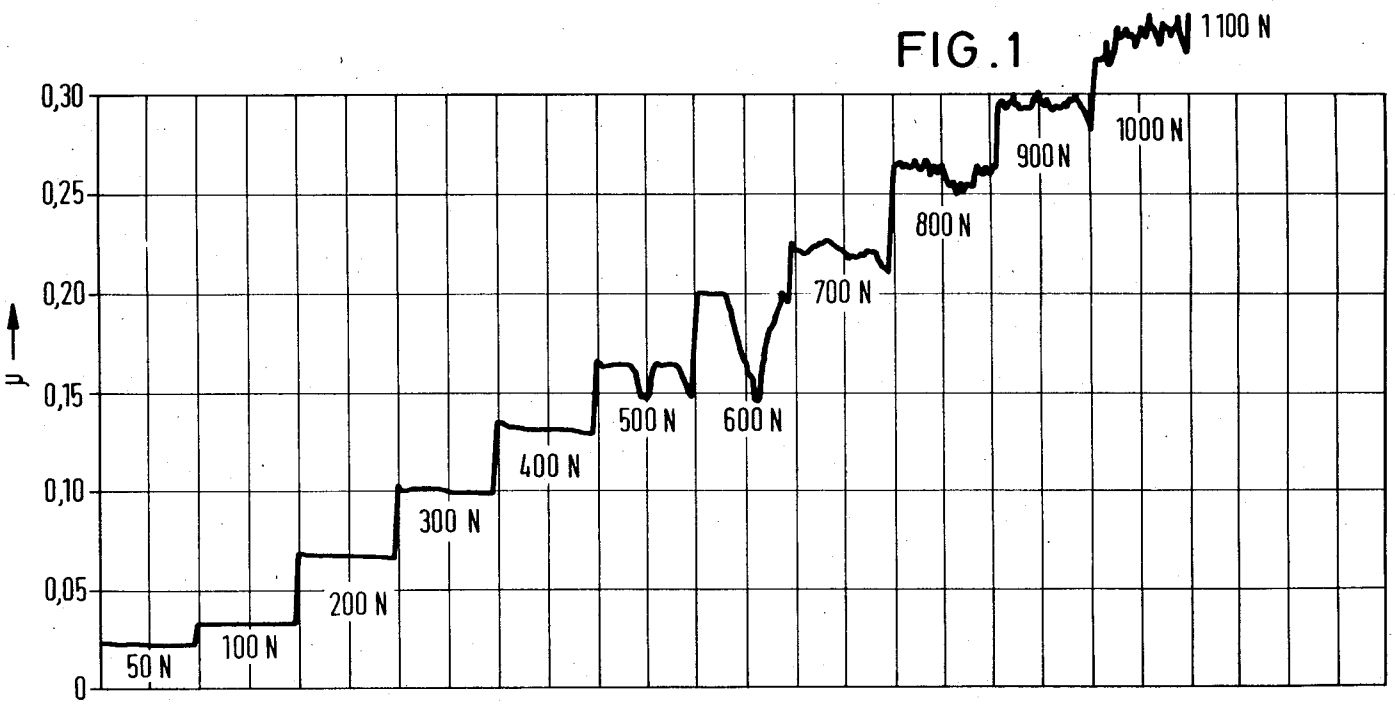
Figure 2:
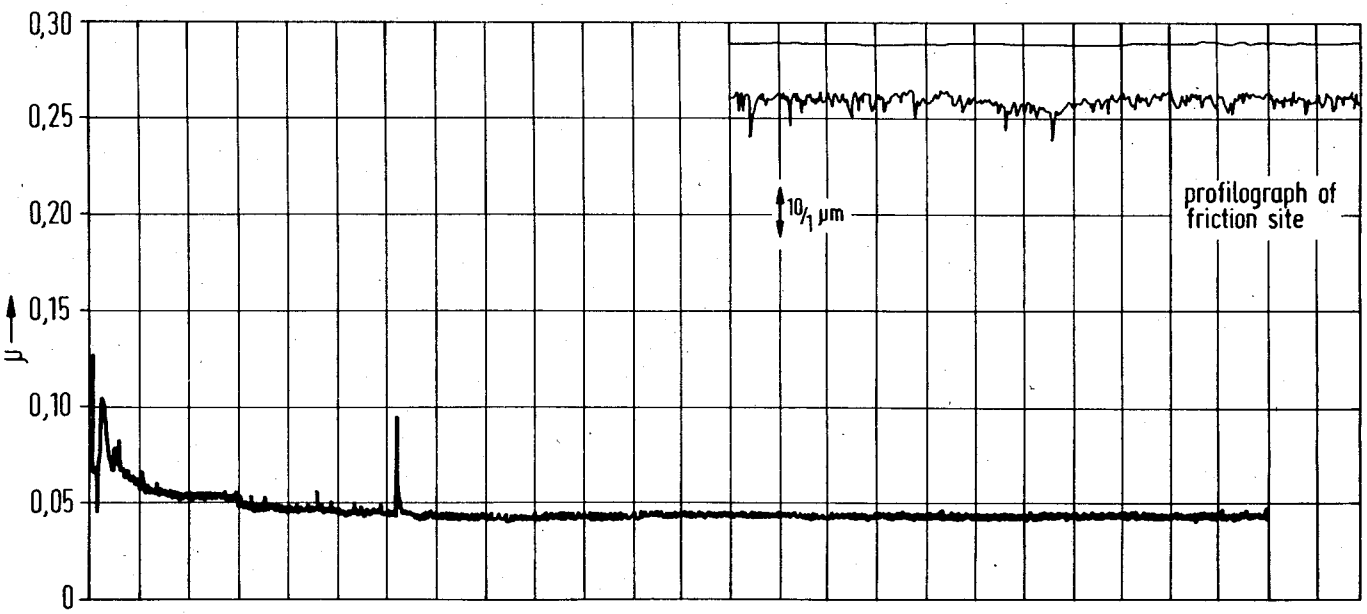
Figure 3:
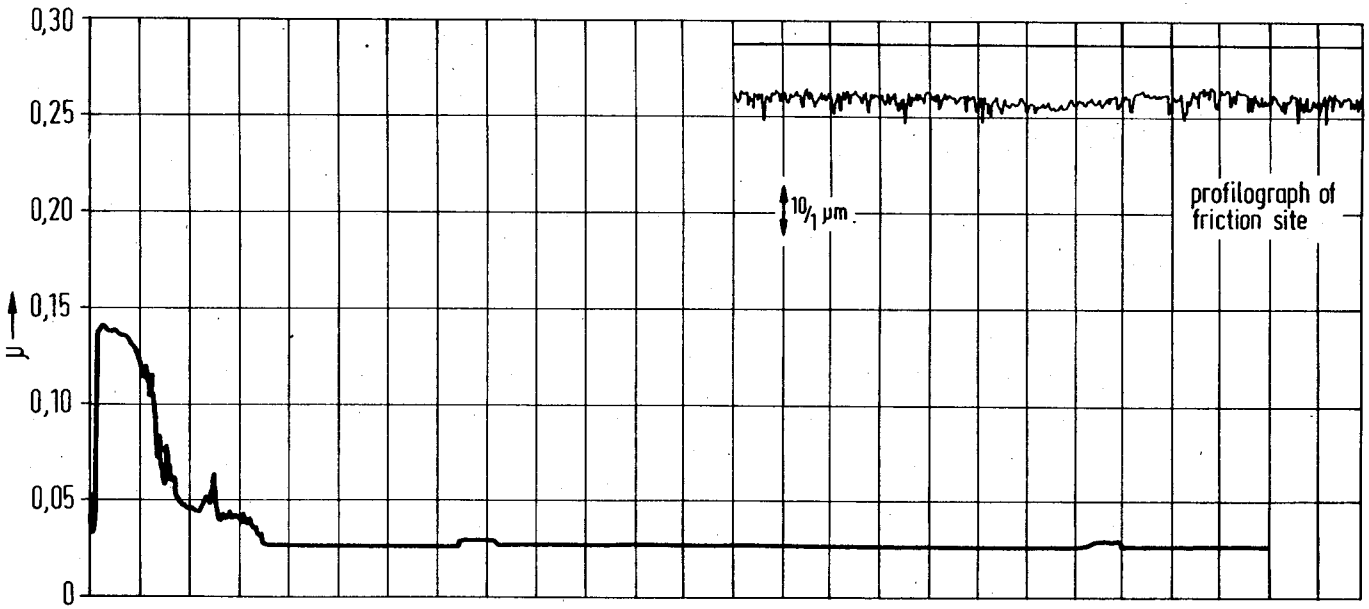
Figure 4:
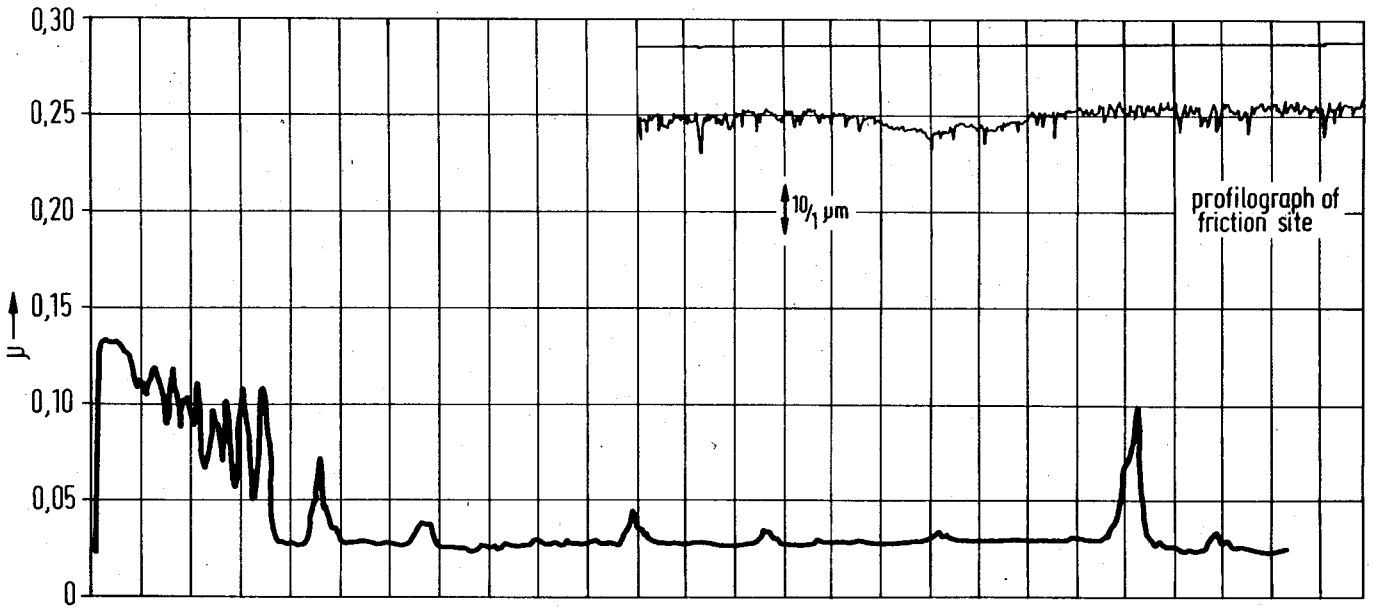
Figure 5:
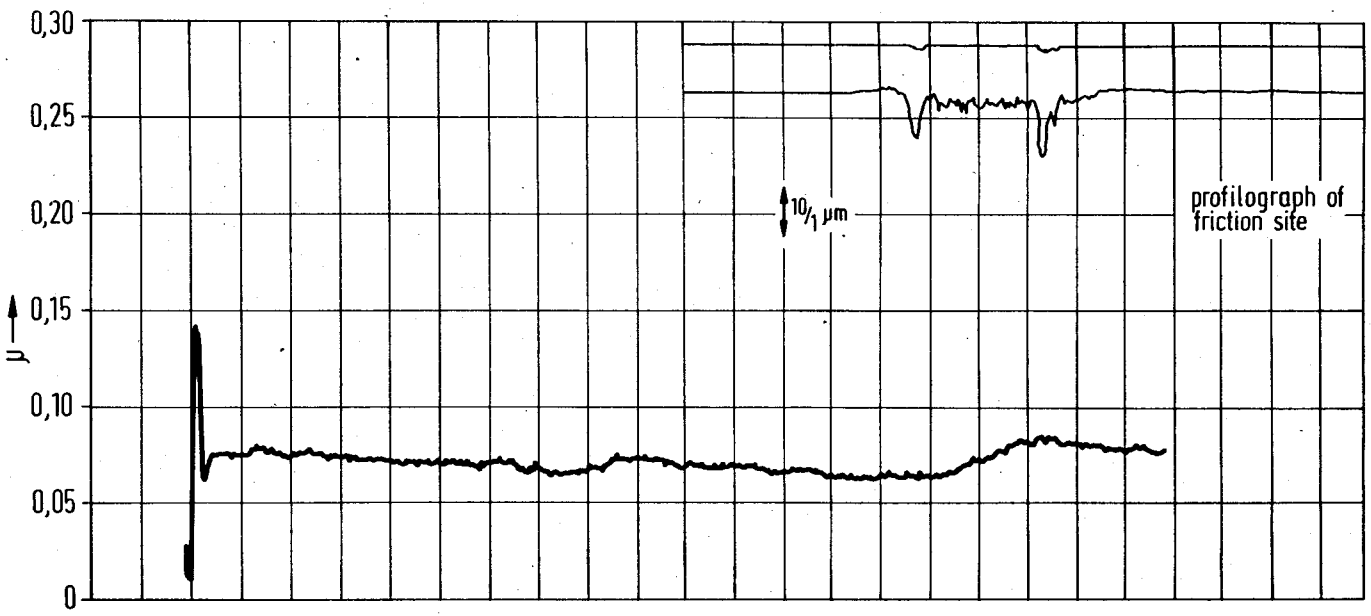
Figure 6:
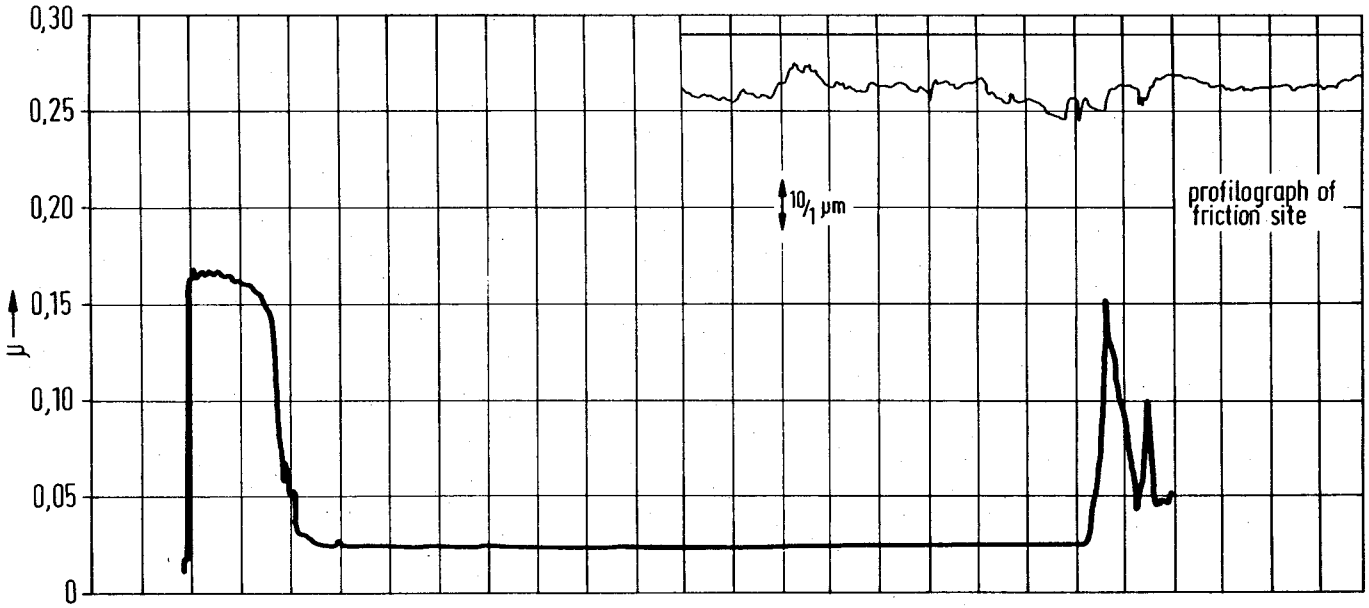
Figure 7:
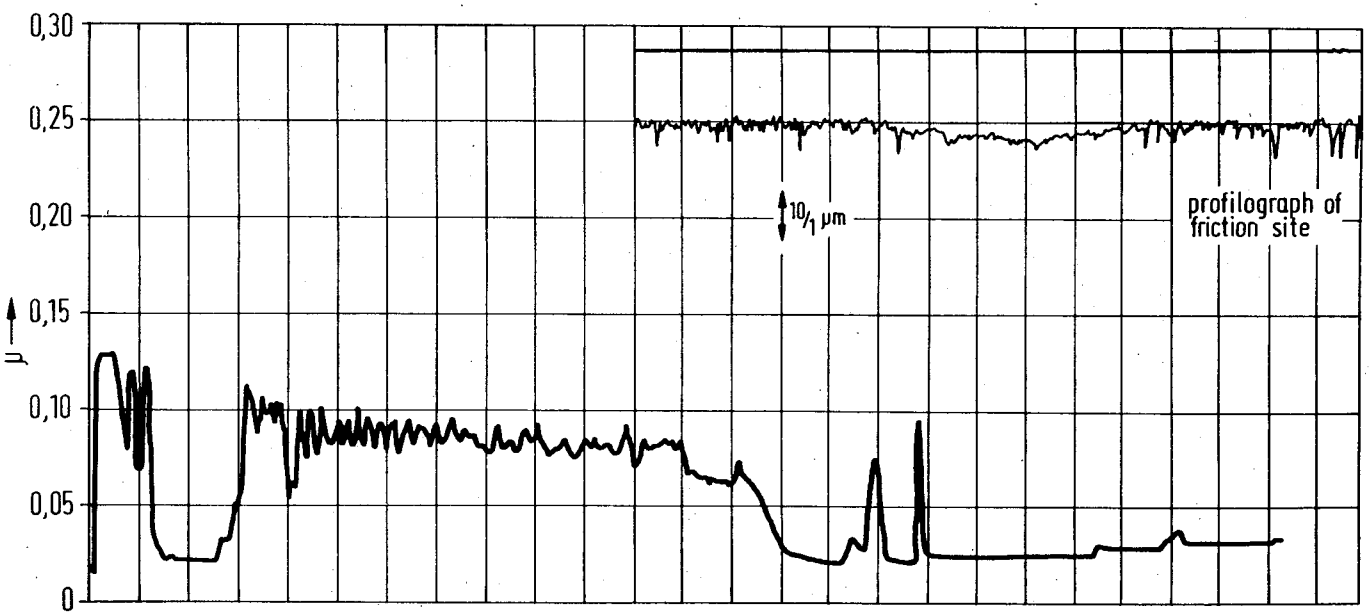
Figure 8:
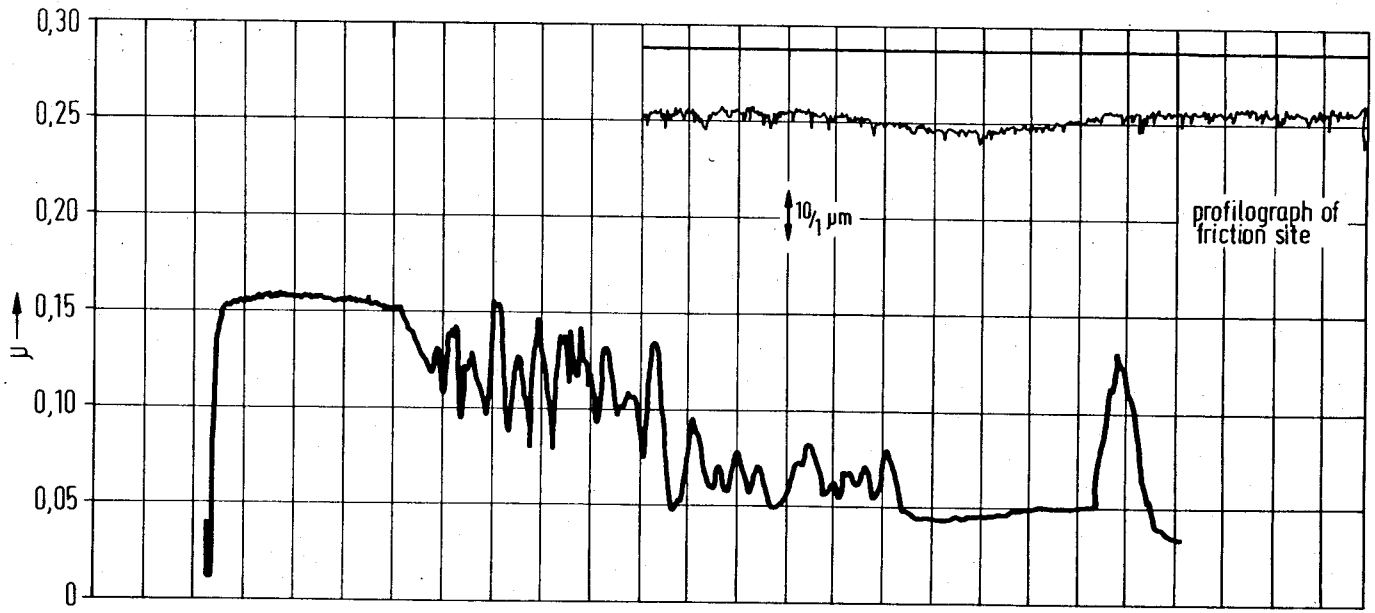
FIG. 8 shows the results with a lubricant composition according to Example 3 (b) which, in comparison with Example 3 (a), contains only half the amount of the lubricant additive according to the present invention; in comparison with FIG. 4 (lubricant composition according to Example 3 (a)), a longer running-in time is admittedly needed but outstanding friction values are then also obtained.
Figure 9:
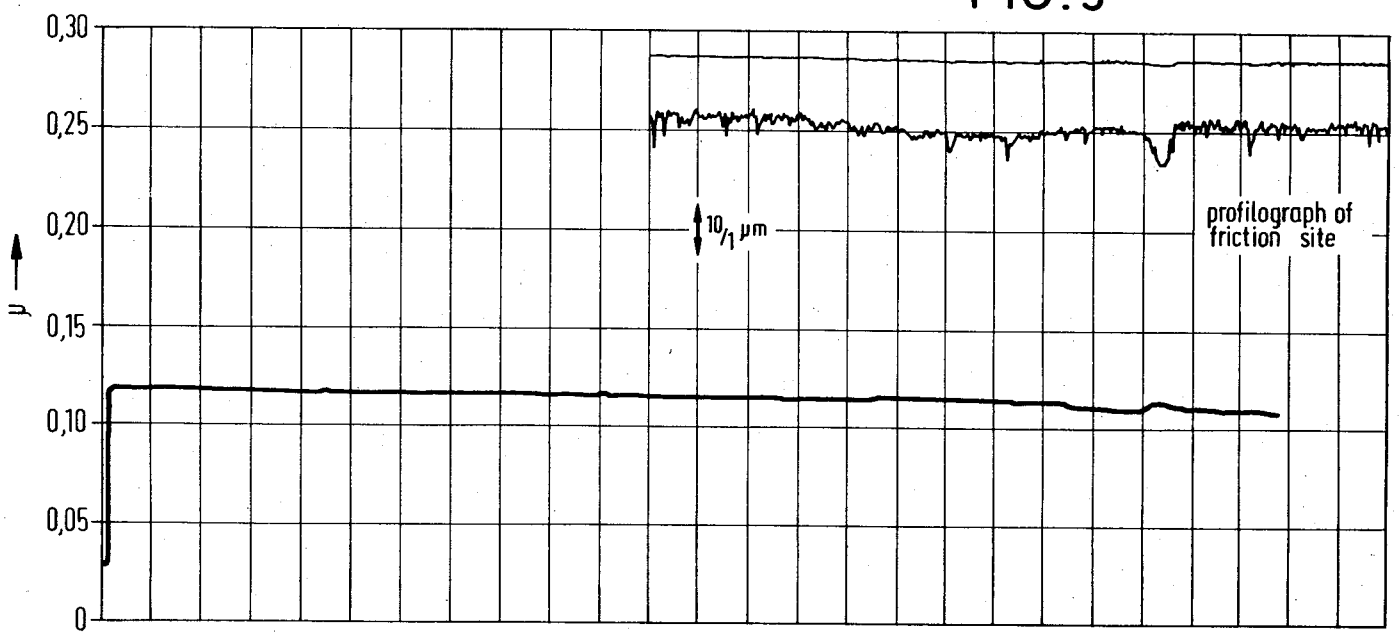
Figure 10:
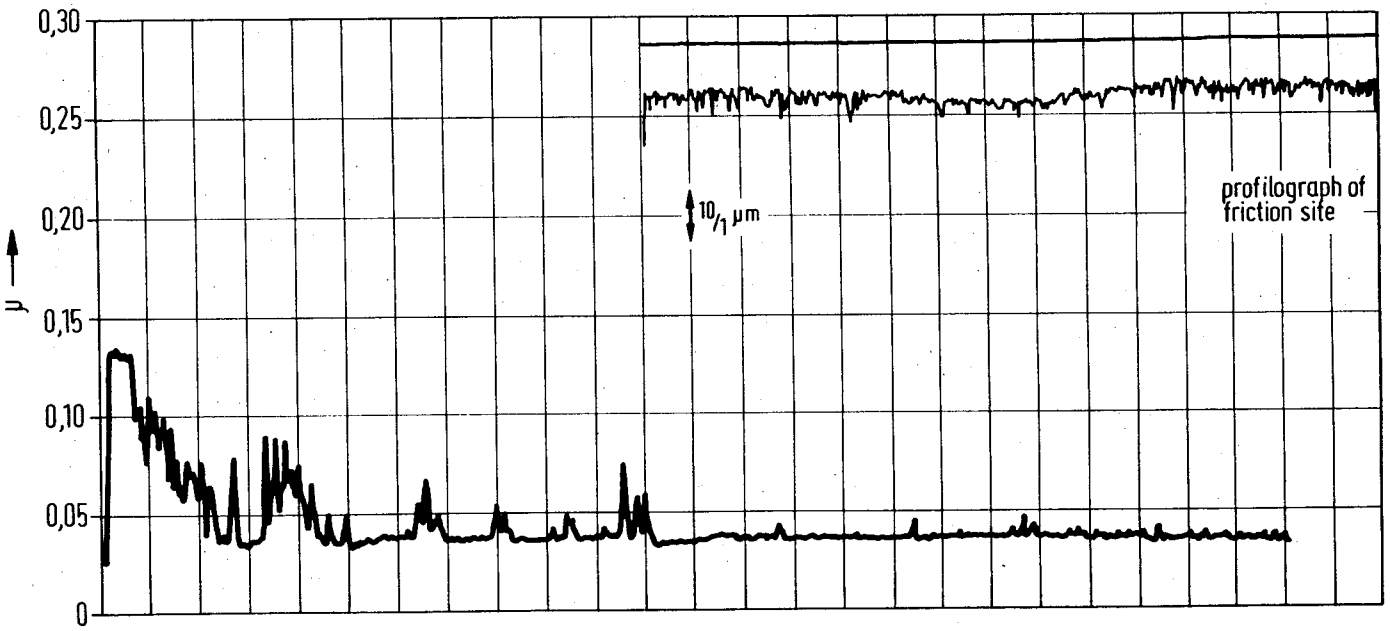
FIG. 10 shows that even with a poly-alpha-olefin of extremely low viscosity as component of the primary grease which, as such, displays especially poor lubricating properties, after the addition of the product according to the present invention, good lubricating properties are obtained.

Col. 5 Chart, under Fig. 8, line 1, "PD GROND" should read -- PD GRUND --

Figure 14:
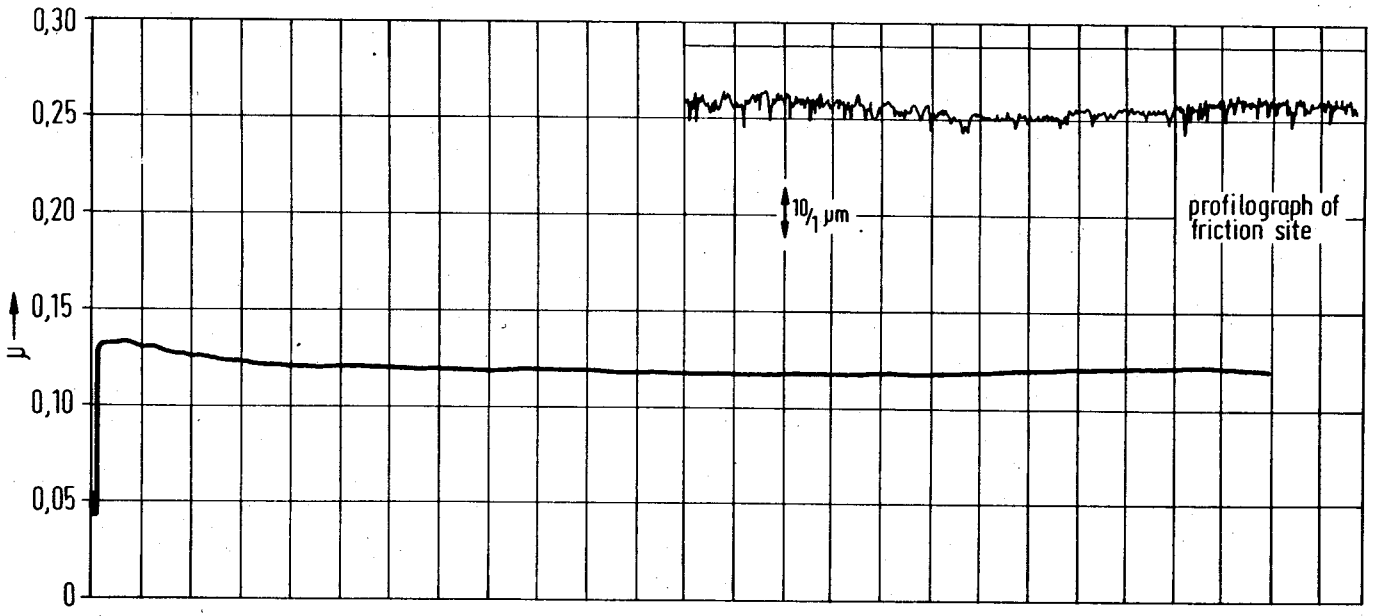
Figure 15:
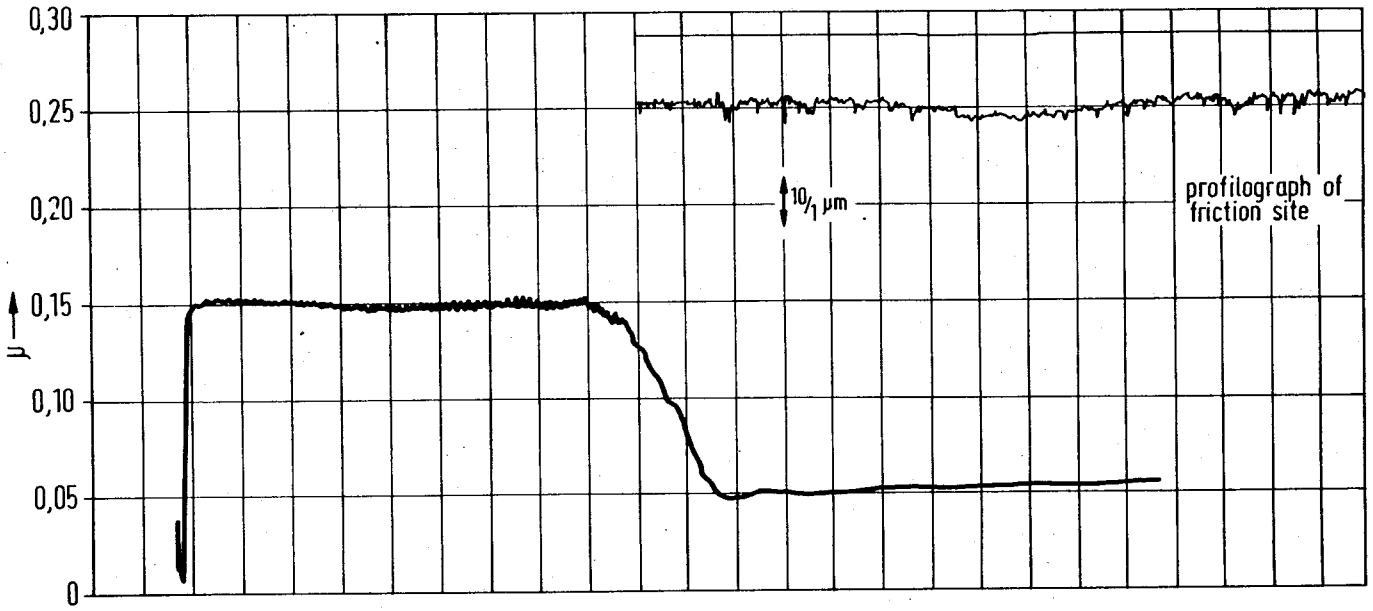
Figure 16:
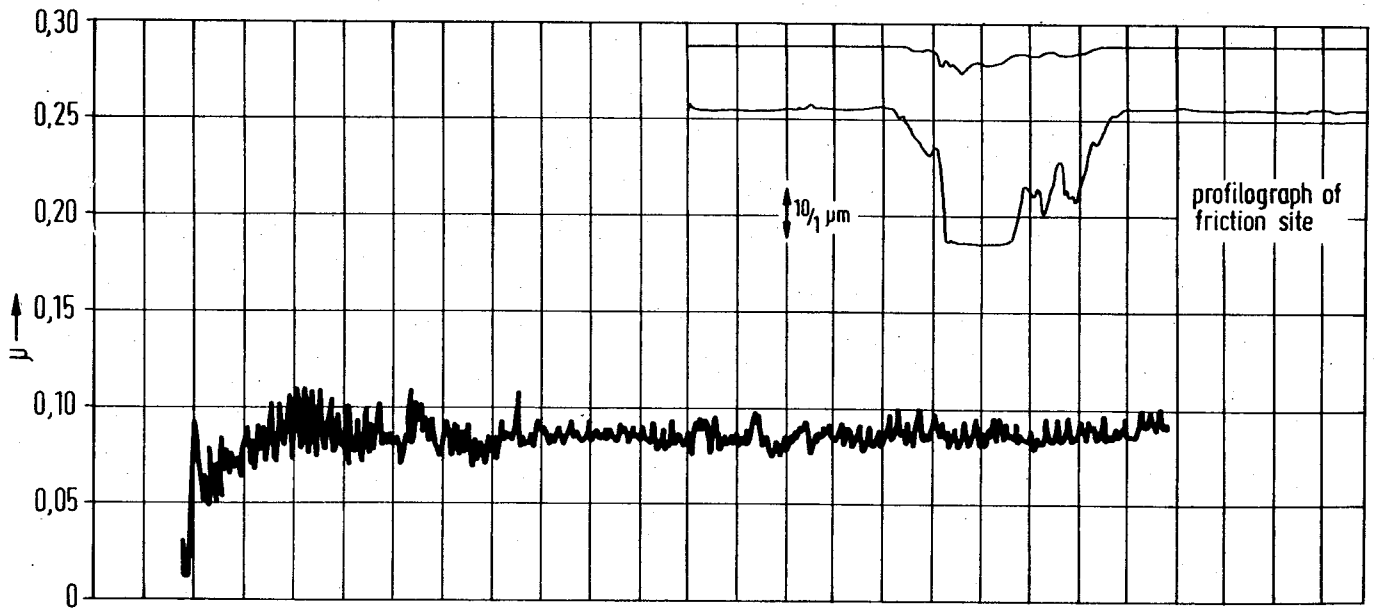
Figure 17:
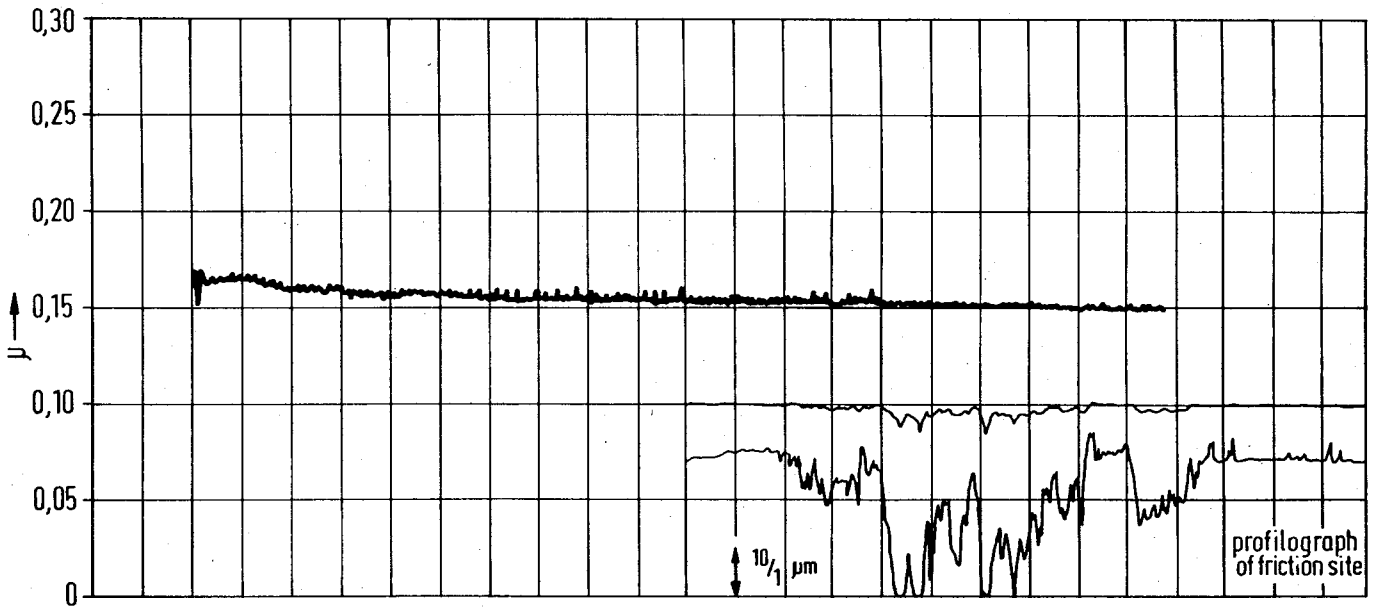
Figure 18:
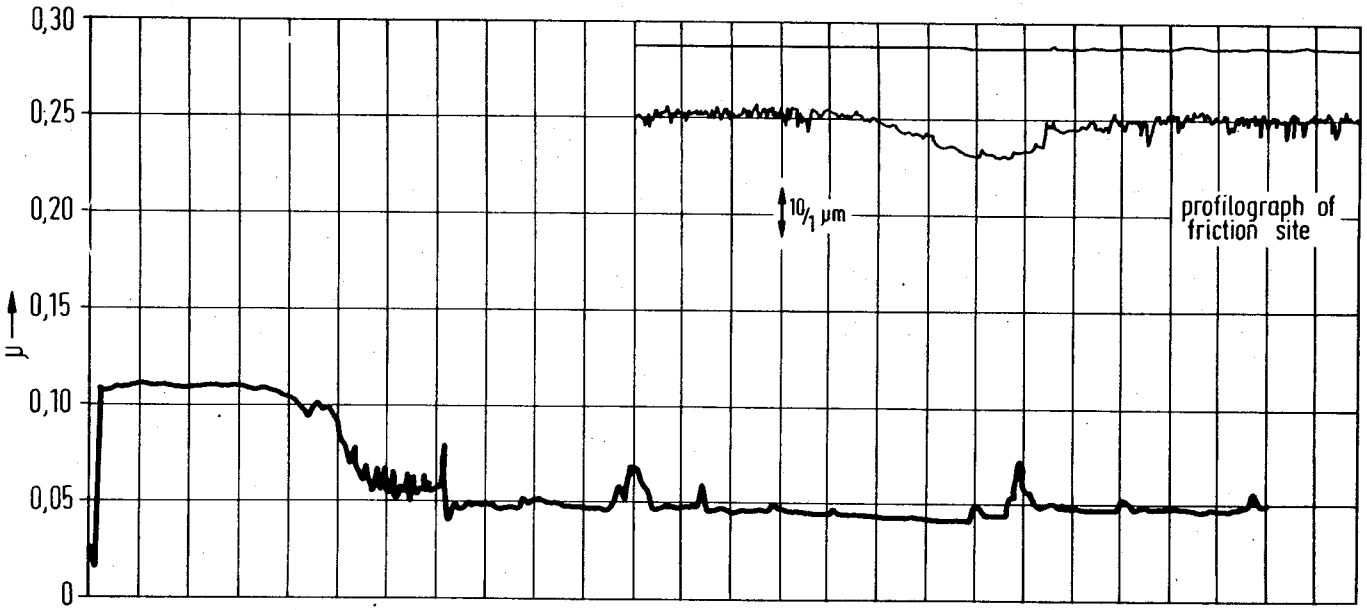
Figure 19:
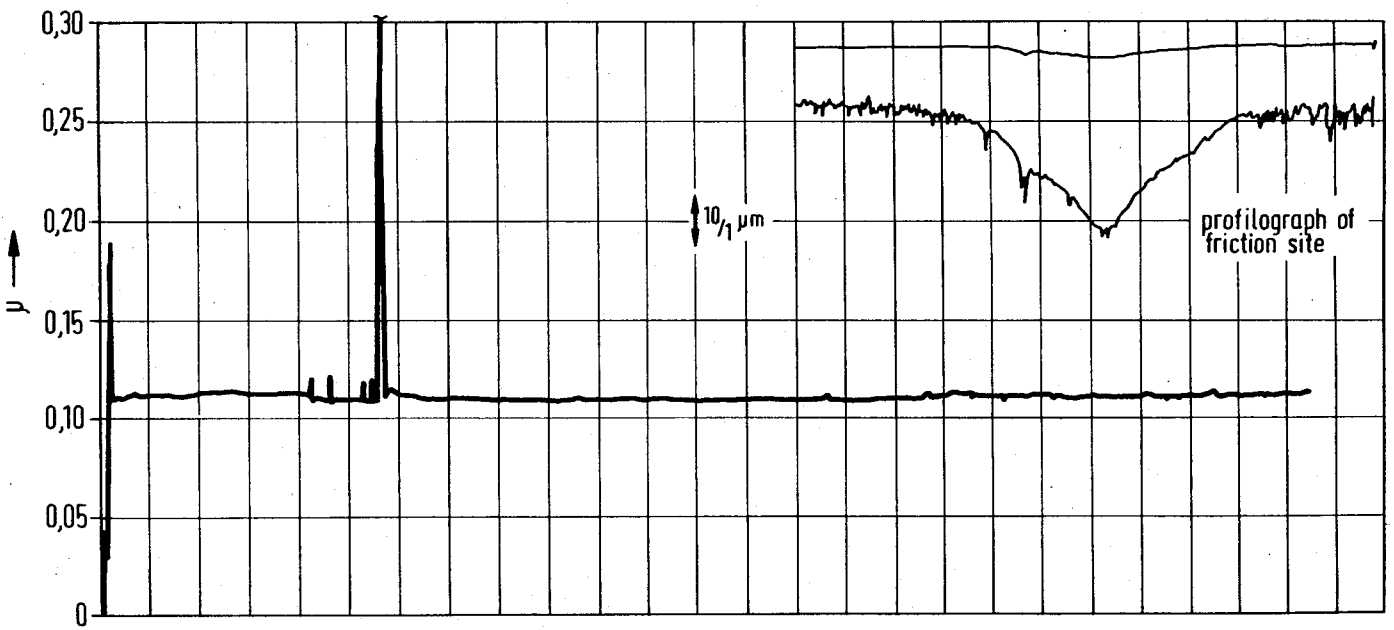
Figure 20:
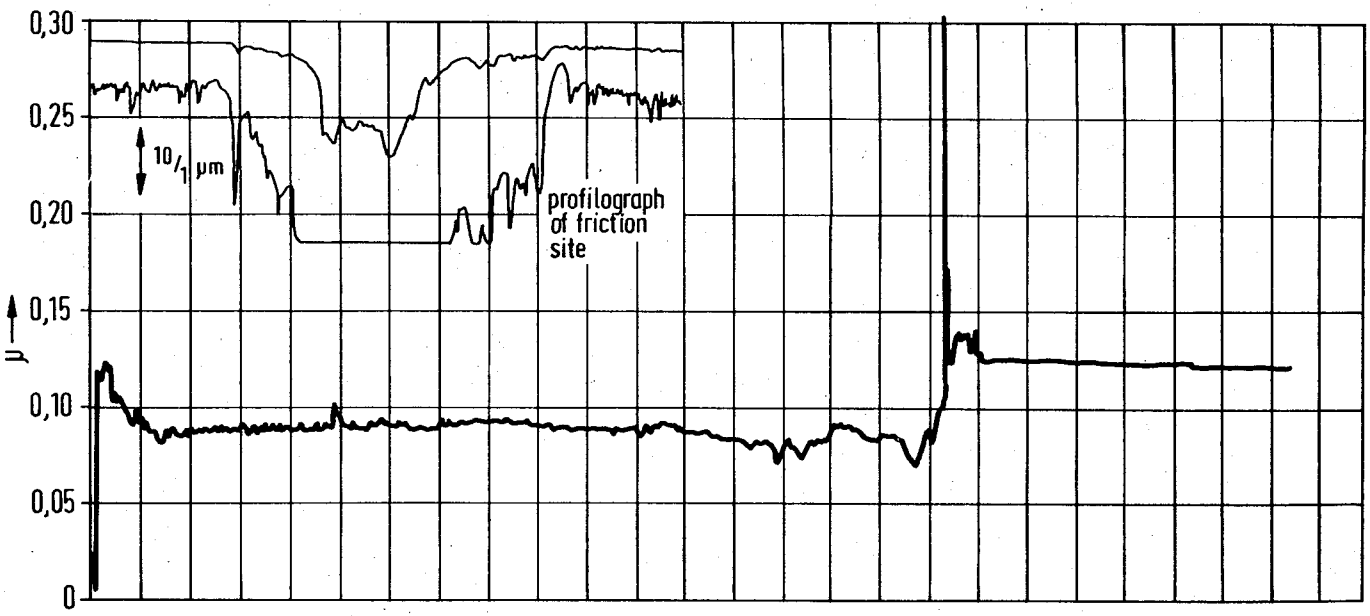

Col. 7 Table, under Fig. 14, line 9, delete "720 m" (first occurrence)

Col. 10, line 24, "190°0 C." should read -- 190°C. --

Signed and Sealed this

Twenty-sixth Day of January, 1988

*Attest:*

DONALD J. QUIGG

*Attesting Officer*

*Commissioner of Patents and Trademarks*